US010156353B2

(12) United States Patent
Chang

(10) Patent No.: US 10,156,353 B2
(45) Date of Patent: Dec. 18, 2018

(54) INSTANTANEOUS HEATER FOR A SMOKE GENERATOR

(71) Applicant: Ming-Cheng Chang, Tainan (TW)

(72) Inventor: Ming-Cheng Chang, Tainan (TW)

( * ) Notice: Subject to any disclaimer, the term of this patent is extended or adjusted under 35 U.S.C. 154(b) by 65 days.

(21) Appl. No.: 15/426,215

(22) Filed: Feb. 7, 2017

(65) Prior Publication Data

US 2017/0363283 A1 Dec. 21, 2017

(30) Foreign Application Priority Data

Jun. 17, 2016 (TW) ..... 105209076 U

(51) Int. Cl.
*F22B 29/06* (2006.01)
*F22B 1/28* (2006.01)
*A63J 5/02* (2006.01)

(52) U.S. Cl.
CPC ..... *F22B 1/282* (2013.01); *A63J 5/025* (2013.01)

(58) Field of Classification Search
None
See application file for complete search history.

(56) References Cited

U.S. PATENT DOCUMENTS 2,324,359 A * 7/1943 Callan ..... A63H 33/28 392/395
3,458,948 A * 8/1969 Schlensker ..... A01M 13/00 219/530
4,480,172 A * 10/1984 Ciciliot ..... F22B 1/288 165/140
4,871,115 A * 10/1989 Hessey ..... A63J 5/025 239/133
5,265,318 A * 11/1993 Shero ..... B23P 11/025 15/321
6,053,435 A * 4/2000 Hung ..... A63J 5/025 239/136
6,421,502 B1 * 7/2002 Aronie ..... A63H 33/28 392/399
7,086,920 B2 * 8/2006 Fusco ..... A63H 33/28 446/15
7,117,867 B2 * 10/2006 Cox ..... A61M 15/0003 128/200.14

(Continued)

FOREIGN PATENT DOCUMENTS

CN 002403475 11/2000 ..... A63J 5/02
CN 202238479 5/2012 ..... B05B 17/04

(Continued)

*Primary Examiner* — Thor Campbell
(74) *Attorney, Agent, or Firm* — Alan D. Kamrath; Kamrath IP Lawfirm, P.A.

(57) ABSTRACT

An instantaneous heater (51) is mounted in a casing (20) of a smoke machine (10). The instantaneous heater (51) includes a heating rod (52), a flow guiding member (131) mounted around the heating rod (52), and an outer tube (64) mounted around the flow guiding member (131). The flow guiding member (131) includes an inner periphery (137) abutting an outer periphery (58) of the heating rod (52). A shallow, rectilinear heating passage (151) is defined in the inner periphery (137) of the flow guiding member (131) to permit a small amount of oil to pass therethrough. The oil can be directly and completely heated and vaporized by the heating rod (52) into smoke.

17 Claims, 12 Drawing Sheets

(56) References Cited

U.S. PATENT DOCUMENTS

| | | | | |
|---|---|---|---|---|
| 7,302,170 | B1 * | 11/2007 | Chen | F22B 1/282 392/398 |
| 8,422,869 | B2 * | 4/2013 | Joseph | A63J 5/025 392/386 |
| 2003/0202785 | A1 | 10/2003 | Monitto | 392/399 |
| 2008/0230052 | A1 * | 9/2008 | Montaser | A61M 15/0085 128/200.16 |
| 2010/0142933 | A1 * | 6/2010 | Vandoninck | A63J 5/025 392/386 |
| 2011/0011396 | A1 * | 1/2011 | Fang | A24F 47/008 128/202.21 |
| 2016/0023123 | A1 * | 1/2016 | Chang | A63J 5/025 392/397 |

FOREIGN PATENT DOCUMENTS

| | | | |
|---|---|---|---|
| CN | 202446827 | 9/2012 | A63J 5/02 |
| CN | 203634835 | 6/2014 | A63J 5/02 |
| WO | WO 009933326 | 7/1999 | H05B 3/00 |

* cited by examiner

INSTANTANEOUS HEATER FOR A SMOKE GENERATOR

BACKGROUND OF THE INVENTION

The present invention relates to an instantaneous heater for a smoke generator and, more particularly, to an instantaneous heater for heating and vaporizing an oil in a smoke generator into smoke.

A smoke generator for providing a stage performance effect generally heats and vaporizes an oil in the smoke generator into smoke, and the smoke is ejected to the outside to provide a smoke effect on the stage. A conventional smoke generator generally includes a heating rod wound around by a helical tube made of heat conducting material. An end of the helical tube is coupled to a pump connected to an oil tank. The heat generated by the heating rod is transmitted to the helical tube. The oil in the helical tube is heated and vaporized into smoke which is ejected outwards from the other end of the helical tube. The helical tube can increase the heating time of the oil to assure reliable vaporization of the oil into smoke.

However, the smoke generator requires a longer period of time for preheating, because the oil is indirectly heated. Furthermore, the contact area between the helical tube and the outside is relatively large, such that most of the heat dissipates rapidly. Thus, a thermal insulating mechanism must be provided to the outer side of the helical tube. Furthermore, the smoke generator cannot continuously operate for a long period of time, because the vaporization speed of the smoke generator is not fast enough due to the indirect heating. Furthermore, since the oil is indirectly heated, 5-10 minutes of preheating is required if the smoke generator is started from a stopped state. Furthermore, when the smoke generator is not generating smoke, the smoke generator must be kept in a standby mode for maintaining the temperature, and the heating rod requires intermittent heating to keep the helical tube at a certain temperature for timely provision of smoke. Thus, the smoke generator must be kept in a high temperature state that might damage associated electronic components, and the volume of the smoke generator must be increased to avoid excessive high temperature at the housing of the smoke generator. Furthermore, more electricity is consumed in keeping the heating state of the heating rod.

Thus, a need exists for a novel instantaneous heater for a smoke generator that mitigates and/or obviates the above disadvantages.

BRIEF SUMMARY OF THE INVENTION

In a first aspect, an instantaneous heater for a smoke generator includes a heating rod having a first section, a second section spaced from the first section along a longitudinal axis, and an outer periphery extending between the first section and the second section. The second section is adapted to be electrically connected to a power supply system of a smoke generator. A first flow guiding member is mounted around the heating rod. The first flow guiding member includes a first end, a second end spaced from the first end along the longitudinal axis, and an inner periphery extending from the first end through the second end. The first flow guiding member further includes a first heating passage defined in the inner periphery of the first flow guiding member and extending from the first end through the second end of the first flow guiding member. The first heating passage is shallow and rectilinear. The first end of the first flow guiding member is aligned with the second section of the heating rod. The inner periphery of the first flow guiding member abuts the outer periphery of the heating rod. An outer tube is mounted around the first flow guiding member. The outer tube includes a first end facing the first section of the heating rod and a second end facing the second section of the heating rod. The outer tube further includes an inner periphery extending from the first end through the second end of the outer tube. The inner periphery of the outer tube defines a chamber. The first flow guiding member is received in the chamber. An end cap is sealingly mounted to the first end of the outer tube. The end cap includes an outlet intercommunicated with the first heating passage. The end cap covers the first section of the heating rod. A connection cap is sealingly mounted to the second end of the outer tube. The connection cap includes a space intercommunicated with the first heating passage. A guiding tube includes a first end coupled to the connection cap and intercommunicated with the space. The guiding tube further includes a second end adapted to be intercommunicated with an oil tank of the smoke generator.

In an example, the end cap includes a compartment defined in an end face thereof. The compartment includes a bottom wall having an abutment face. The first section of the heating rod has an end face abutting the abutment face of the end cap. The end cap further includes a guiding groove defined in the abutment face. The first heating passage is aligned with the guiding groove in a circumferential direction about the longitudinal axis.

In an example, the first end of the first flow guiding member is located in the compartment of the end cap, and the second end of the first flow guiding member is located in the space of the connection cap.

In an example, a ratio of a thickness between the inner periphery and the outer periphery of the first flow guiding member in a radial direction perpendicular to the longitudinal axis to a radial thickness of the heating rod in the radial direction is between 1:6 and 1:8. A ratio of a depth of each first heating passage in the radial direction to the thickness between the inner periphery to the outer periphery of the first flow guiding member is between 1:1.5 and 1:2.5.

In an example, the end cap further includes a compartment. The first end of the outer tube is coupled in the compartment of the end cap. The first end of the first flow guiding member is located in the compartment of the end cap. The instantaneous heater further includes a second flow guiding member having a head end and a tail end spaced from the head end along the longitudinal axis. The second flow guiding member further includes an inner periphery and a second heating passage defined in the inner periphery of the second flow guiding member and extending from the head end through the tail end of the second flow guiding member. The second flow guiding member is mounted around the heating rod. The head end of the second flow guiding member abuts the second end of the first flow guiding member. The tail end of the second flow guiding member is located in the space of the connection cap.

In an example, the first heating passage of the first flow guiding member is spaced from the second heating passage of the second flow guiding member in the circumferential direction.

In an example, the second end of the first flow guiding member includes an end face having a first recessed portion. The head end of the second flow guiding member includes an end face having a second recessed portion. The first recessed portion and the second recessed portion together define an annular groove.

In an example, the annular groove formed by the first and second recessed portions is substantially V-shaped in a diametric cross section.

In a second aspect, an instantaneous heater for a smoke generator includes a heating rod having a first section, a second section spaced from the first section along a longitudinal axis, and an outer periphery extending between the first section and the second section. The second section is adapted to be electrically connected to a power supply system of a smoke generator. Three first flow guiding members are mounted around the heating rod in sequence. Each of the three first flow guiding members includes a first end, a second end spaced from the first end along the longitudinal axis, and an inner periphery extending from the first end through the second end. Each of the three first flow guiding members further includes a first heating passage defined in the inner periphery thereof and extending from the first end through the second end thereof. The first heating passages are shallow and rectilinear. The three first flow guiding members includes a front first flow guiding member, a rear first flow guiding member, and a middle first flow guiding member located between the front and rear first flowing guiding members. The first end of the middle first flow guiding member abuts the second end of the front first flow guiding member. The second end of the middle first flow guiding member abuts the first end of the rear first flow guiding member. The inner periphery of each of the three first flow guiding members abuts the outer periphery of the heating rod. A second flow guiding member has a head end and a tail end spaced from the head end along the longitudinal axis. The second flow guiding member further includes an inner periphery and a second heating passage defined in the inner periphery of the second flow guiding member and extending from the head end through the tail end of the second flow guiding member. The second flow guiding member is mounted around the heating rod. The head end of the second flow guiding member abuts the second end of the rear first flow guiding member. An outer tube is mounted around the three first flow guiding members. The outer tube includes a first end facing the first section of the heating rod and a second end facing the second section of the heating rod. The outer tube further includes an inner periphery extending from the first end through the second end of the outer tube. The inner periphery of the outer tube defines a chamber. The three first flow guiding members are received in the chamber. An end cap is sealingly mounted to the first end of the outer tube. The end cap includes an outlet intercommunicated with the first heating passage. The end cap covers the first section of the heating rod. A connection cap is sealingly mounted to the second end of the outer tube. The connection cap includes a space intercommunicated with the first heating passage. The tail end of the second flow guiding member is located in the space of the connection cap. A guiding tube includes a first end coupled to the connection cap and intercommunicated with the space. The guiding tube further includes a second end adapted to be intercommunicated with an oil tank of the smoke generator.

In an example, each of the three first flow guiding members further includes a first recessed portion defined in an end face of each of the first and second ends thereof. The second flow guiding member includes a second recessed portion defined in an end face of the head end. The first recessed portions of the front and middle first flow guiding members together define a first annular groove. The first recessed portions of the middle and rear first flow guiding members together define a second annular groove. The first recessed portion of the rear first flow guiding member and the second recessed portion of the second flow guiding member together define a third annular groove.

In an example, each of the first, second, and third annular grooves is substantially V-shaped in a diametric cross section.

In an example, a ratio of a thickness between the inner periphery and the outer periphery of the first flow guiding member in a radial direction perpendicular to the longitudinal axis to a radial thickness of the heating rod in the radial direction is between 1:6 and 1:8. A ratio of a depth of each first heating passage in the radial direction to the thickness between the inner periphery to the outer periphery of the first flow guiding member is between 1:1.5 and 1:2.5.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
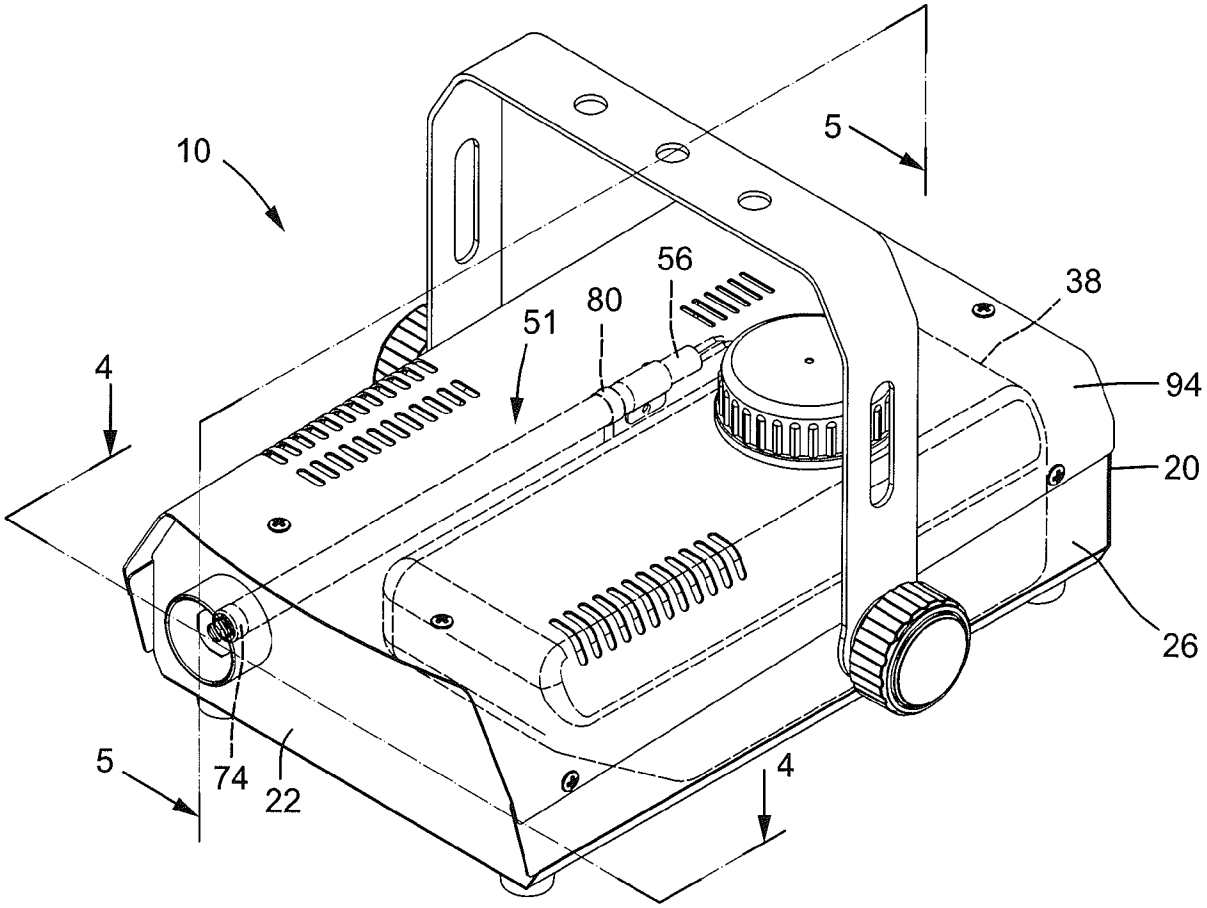
FIG. 1 is a perspective view of a smoke generator according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "bottom", "inner", "outer", "side", "end", "portion", "section", "part", "longitudinal", "length", "thickness", "depth", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 2:
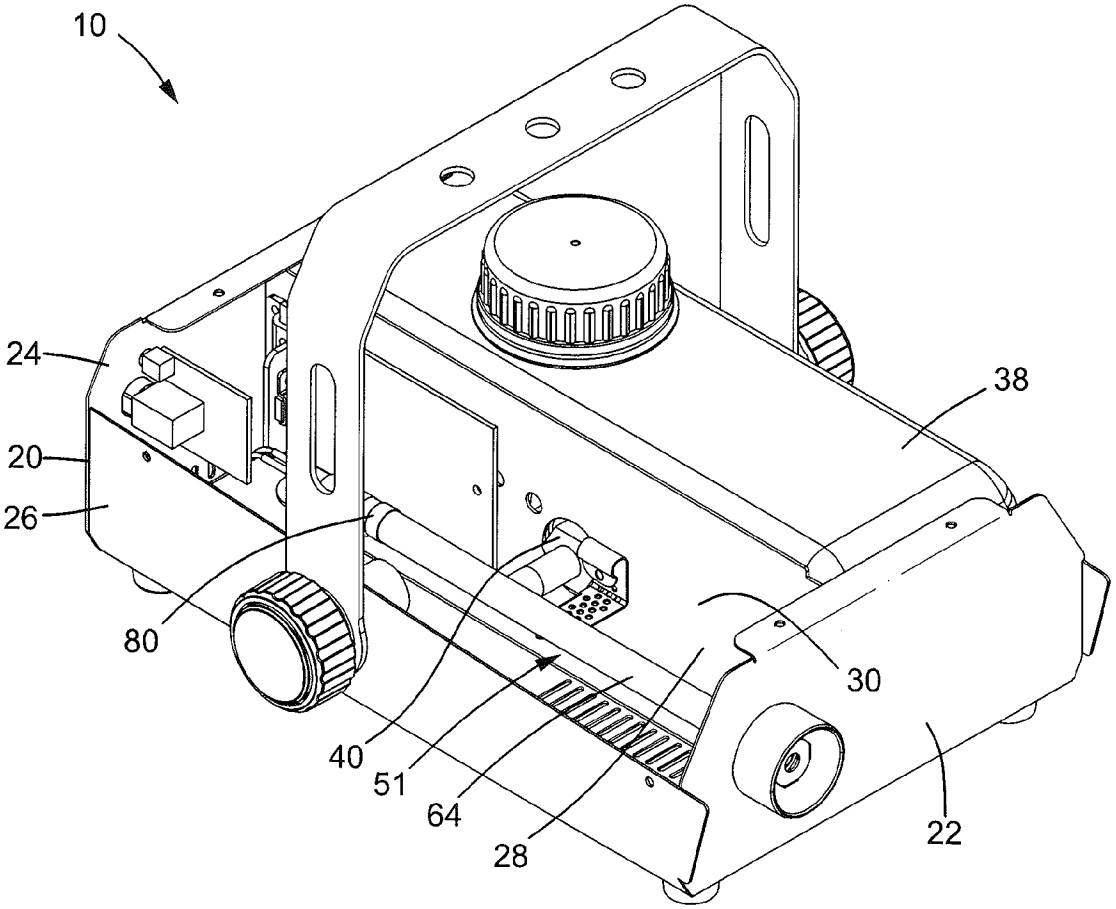
FIG. 2 is another perspective view of the smoke generator of FIG. 1, with a housing of the smoke generator removed for clarity.
Figure 3:
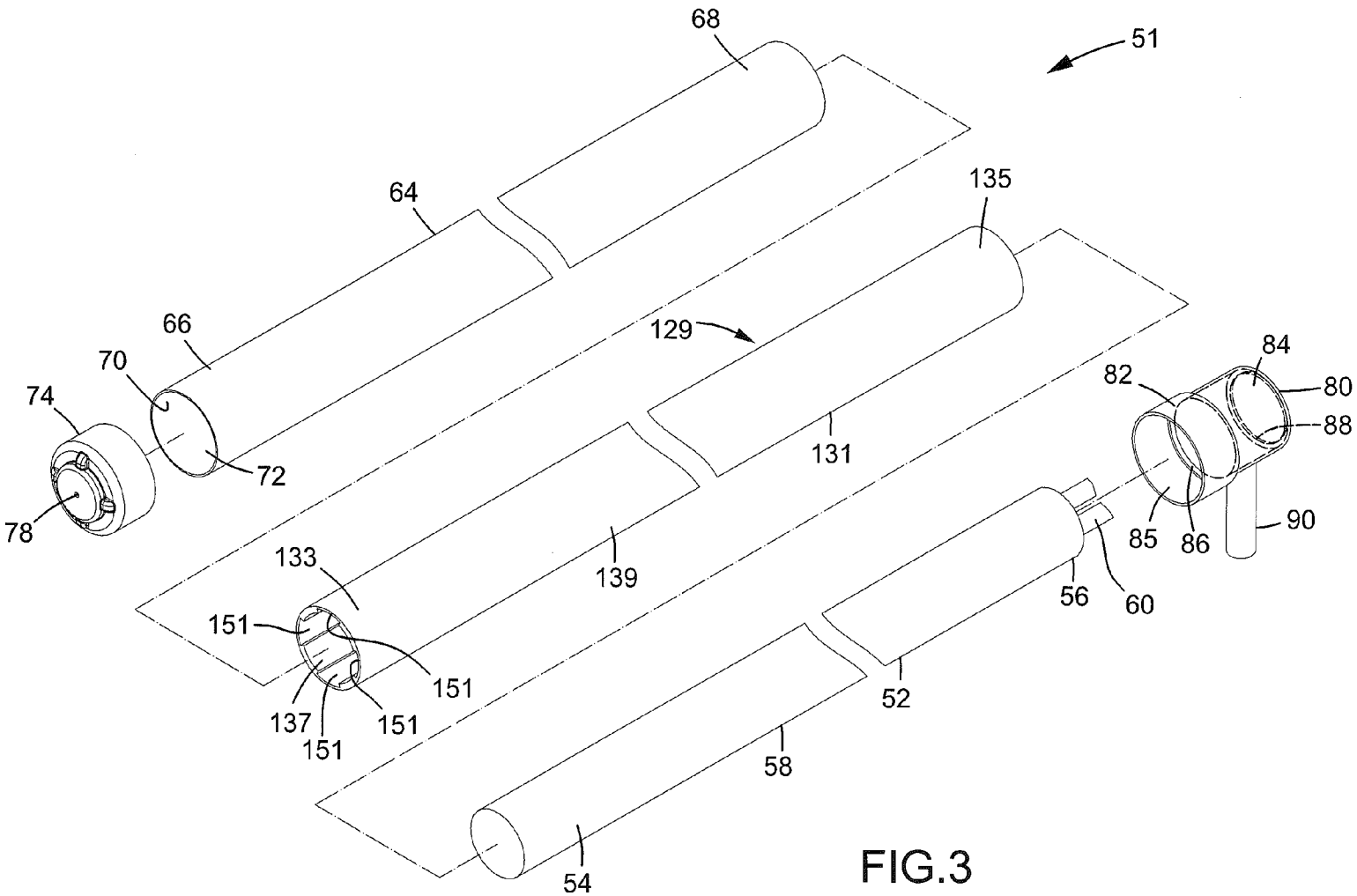
FIG. 3 is an exploded, perspective view of an instantaneous heater of a first embodiment used in the smoke generator according to the present invention.
Figure 4:
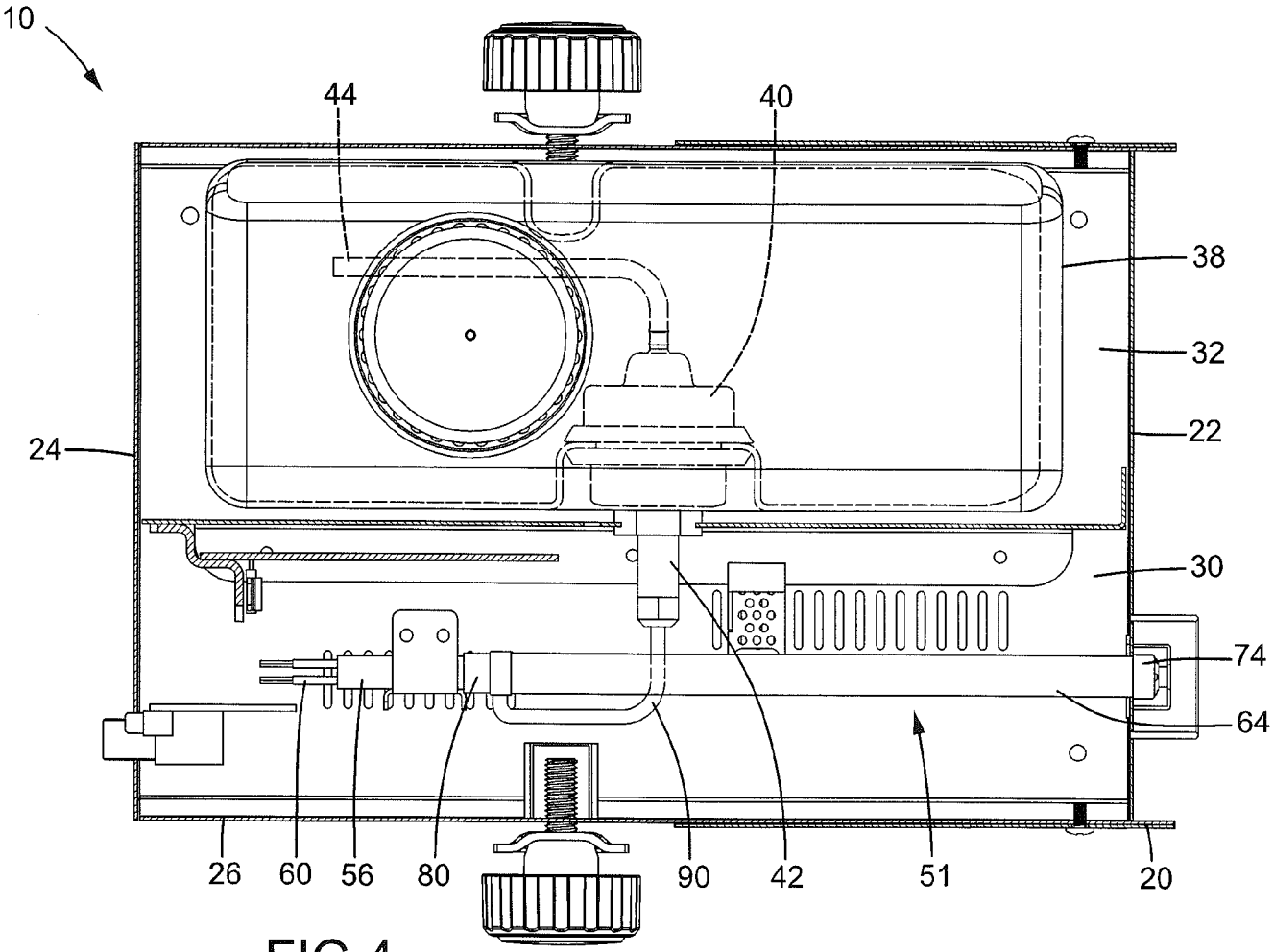
FIG. 4 is a cross sectional view taken along section line 4-4 of FIG. 1.
Figure 5:
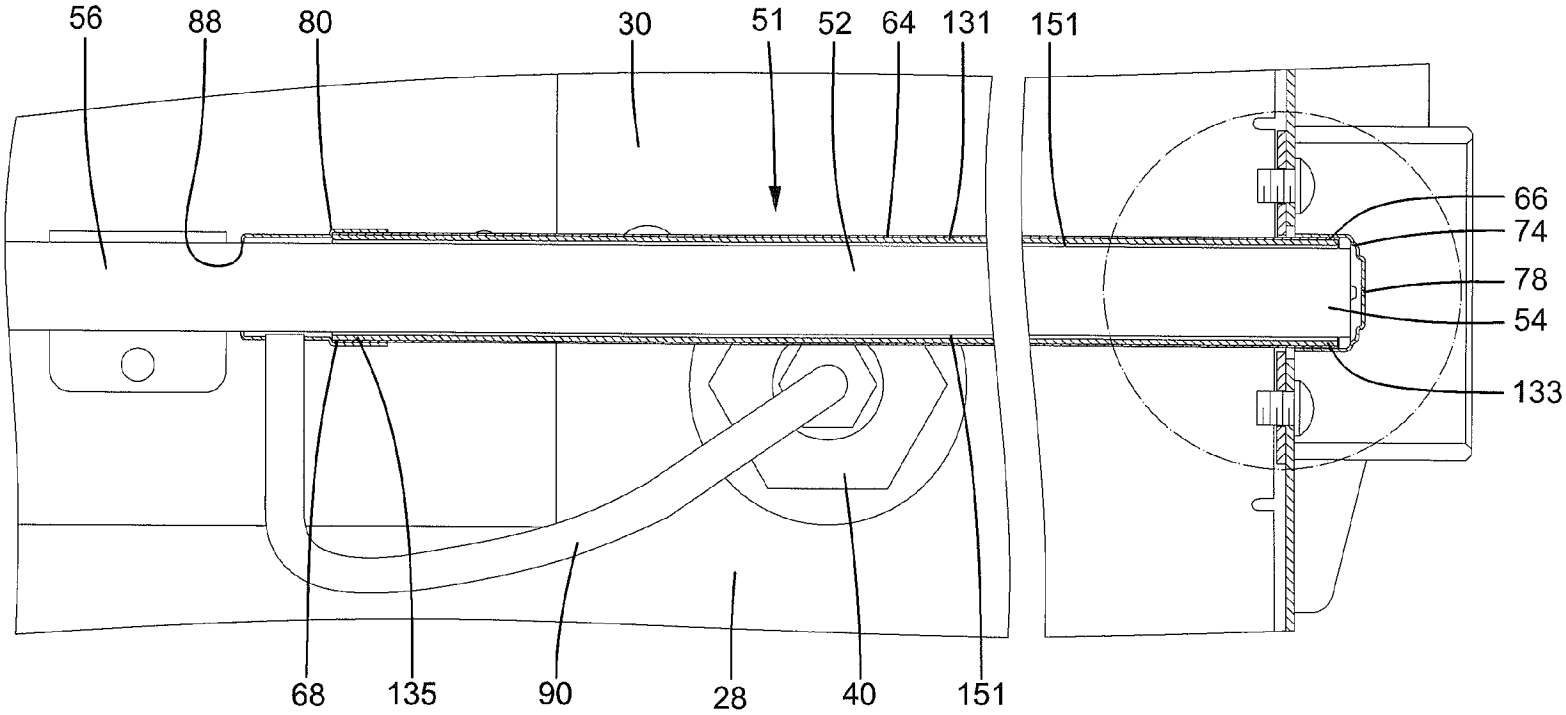
FIG. 5 is a cross sectional view taken along section line 5-5 of FIG. 1.
Figure 6:
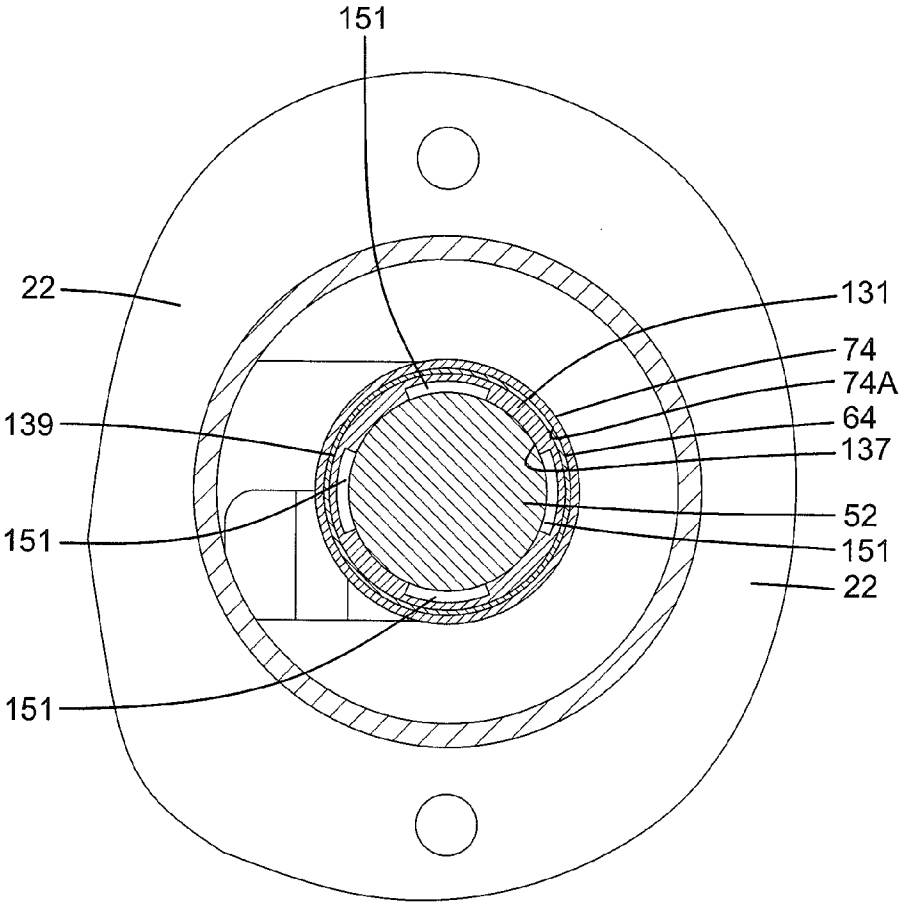
FIG. 6 is a cross sectional view taken along section line 6-6 of FIG. 5.
Figure 7:
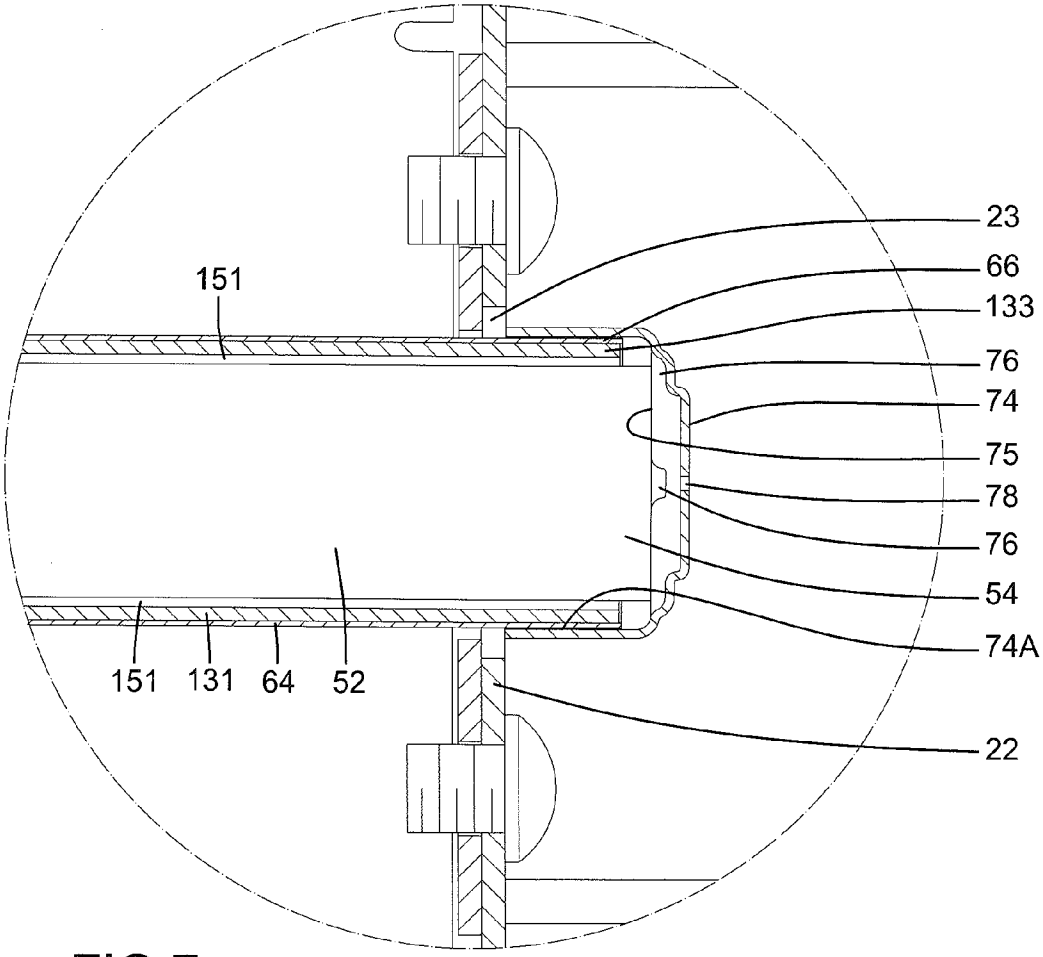
FIG. 7 is an enlarged view of a circled portion of FIG. 5.

With reference to FIGS. 1-7, an instantaneous heater 51 of a first embodiment according to the present invention is mounted in a casing 20 of a smoke generator 10. The casing 20 includes a first board 22, a second board 24 opposite to first board 22, and a bottom board 26 extending between the first board 22 and the second board 24. The first board 22 has a through-hole 23. The casing 20 further includes a partitioning board 28 mounted on the bottom board 26 and extending between the first board 22 and the second board 24. The partitioning board 28 separates the interior of the casing 20 into a first compartment 30 and a second compartment 32. The second compartment 32 receives an oil tank 38 and a pump 40. The oil tank 38 receives an oil that can be heated to vaporize into smoke. The pump 40 includes a coupler 42 and a pipe 44 connected to the oil tank 38. When the pump 40 operates, the oil in the oil tank 38 is pumped through the pipe 44. The coupler 42 of the pump 40 is located in the first compartment 30.

The instantaneous heater 51 is mounted in first space 30 and includes a heating rod 52 having circular cross sections. The heating rod 52 includes a first section 54 and a second section 56 spaced from the first section 54 along a longitudinal axis. The heating rod 52 further includes an outer periphery 58 extending from the first section 54 through the second section 56. The outer periphery 58 is free of grooves and protrusions. The second section 56 of the heating rod 52 is connected to a power cord 60 connected to a power supply system of the smoke generator 10. Thus, when the smoke generator 10 is started, the heating rod 52 generates heat energy.

The instantaneous heater 51 further includes a flow guiding device 129 mounted around the heating rod 52. The flow guiding device 129 includes a first flow guiding member 131 in the form of a hollow tube in this embodiment and having first and second ends 133 and 135 spaced from each other along the longitudinal axis. A longitudinal length of the first flow guiding member 131 along the longitudinal axis is slightly smaller than a longitudinal length of the heating rod 52 along the longitudinal axis. The first flow guiding member 131 includes an outer periphery 139 and an inner periphery 137 spaced from the outer periphery 139 in a radial direction perpendicular to the longitudinal axis. The first flow guiding member 131 further includes four first heating passages 151 defined in the inner periphery 137 and extending from the first end 133 through the second end 135 of the first flow guiding member 131. A ratio of a depth of each first heating passage 151 in the radial direction to a thickness between the inner periphery 137 to the outer periphery 139 of the first flow guiding member 131 is between 1:1.5 and 1:2.5. Namely, each first heating passage 151 is a shallow, rectilinear channel. Furthermore, the first heating passages 151 are equi-angularly disposed the inner periphery 137 in a circumferential direction about the longitudinal axis.

The first flow guiding member 131 is mounted around the heating rod 52. The inner periphery 137 of the first flow guiding member 131 abuts the outer periphery 58 of the heating rod 52. The first end 133 of the first flow guiding member 131 is aligned with the first section 54 of the heating rod 52. The second end 135 of the first flow guiding member 131 is adjacent to the second section 56 of the heating rod 52. A ratio of the thickness between the inner periphery 137 and the outer periphery 139 of the first flow guiding member 131 to a radial thickness of the heating rod 52 in the radial direction is between 1:6 and 1:8.

The instantaneous heater 51 further includes an outer tube 64 mounted around the first flow guiding member 131. A longitudinal length of the outer tube 64 is smaller than a longitudinal length of the heating rod 52. The outer tube 64 includes a first end 66, a second end 68 spaced from the first end 66 along the longitudinal axis, and an inner periphery 70 extending from the first end 66 through the second end 68. The inner periphery 70 of the outer tube 64 defines a chamber 72 having an inner diameter larger than an outer diameter of the heating rod 52. The first end 66 of the outer tube 64 is substantially flush with an end face of the first section 54 of the heating rod 52 and an end face of the first end 133 of the first flow guiding member 13. The second end 68 of the outer tube 64 faces the second section 56 of the heating rod 52. The first flow guiding member 131 is received in the chamber 72 of the outer tube 64. The outer periphery 139 of the first flow guiding member 131 abuts the inner periphery 70 of the outer tube 64.

The instantaneous heater 51 further includes an end cap 74 sealing mounted to the first end 66 of the outer tube 64. The end cap 74 includes a compartment 74A defined in an end face thereof. The compartment 74A includes a bottom wall having an abutment face 75. The end cap 74 further includes four guiding grooves 76 defined in the abutment face 75. The end cap 74 further includes an outlet 78 extending from an outer face of the end cap 74 through the abutment face 75 (see FIG. 7). The first end 66 of the outer tube 64 is coupled in the compartment 74A of the end cap 74. The peripheral edge of the end cap 74 and the outer periphery of the outer tube 64 are sealed by welding. The end face of the first section 54 of the heating rod 52 abuts the abutment face 75 of the end cap 74. The first end 133 of the first flow guiding member 131 is located in the compartment 74A of the end cap 74. Thus, each guiding groove 76 intercommunicates with the corresponding first heating passage 151 (see FIG. 7).

The instantaneous heater 51 further includes a connection cap 80 sealingly mounted around the second end 68 of the outer tube 64. The connection cap 80 includes a first part 82 and a second part 84 having an outer diameter smaller than an outer diameter of the first part 82. The connection cap 80 further includes a space 85 extending from the first part 82 through the second part 84. The space 85 receives the second end 68 of the outer tube 64 and the heating rod 52. A stepped portion 86 is formed in the space 85 at an intersection between the first part 82 and the second part 84. The connection cap 80 further includes a coupling hole 88 extending from an outer periphery of the second part 84 to the space 85. An end of a guiding tube 90 is coupled to the coupling hole 88 of the connection cap 80. The connection cap 80 is mounted around the second end 68 of the outer tube 64. The second end 68 of the outer tube 64 abuts the stepped portion 86. The second section 56 of the heating rod 52 extends out of the second part 84 of the connection cap 80. The second end 135 of the first flow guiding member 131 is located in the space 85 of the connection cap 80.

The heater 51 is received in the first compartment 30 of the casing 20. The first end 133 of the first flow guiding member 131, the first end 66 of the outer tube 64, and the end cap 74 are located outside of the casing 20. The other end of the guiding tube 90 is coupled to the coupler 42 of the pump 40. Furthermore, a housing 94 is mounted outside of the casing 20 of the smoke generator 10 to seal the first and second compartments 30 and 32.

In use, after the smoke generator 10 has been started, the heating rod 52 begins to generate heat, and then the pump 40 can be started in seconds to pump the oil in the oil tank 38 through the pipe 46 and the guiding tube 90 to the first heating passages 151 of the instantaneous heater 51. Since each first heating passage 151 is shallow and rectilinear, the amount of oil entering each first heating passage 151 is small and can be completely heated and vaporized into smoke by the heating rod 52. The smoke moves through the guiding grooves 76 of the end cap 74 and is ejected outwards via the outlet 78. Thus, the smoke can be ejected to the outside.

Figure 8:
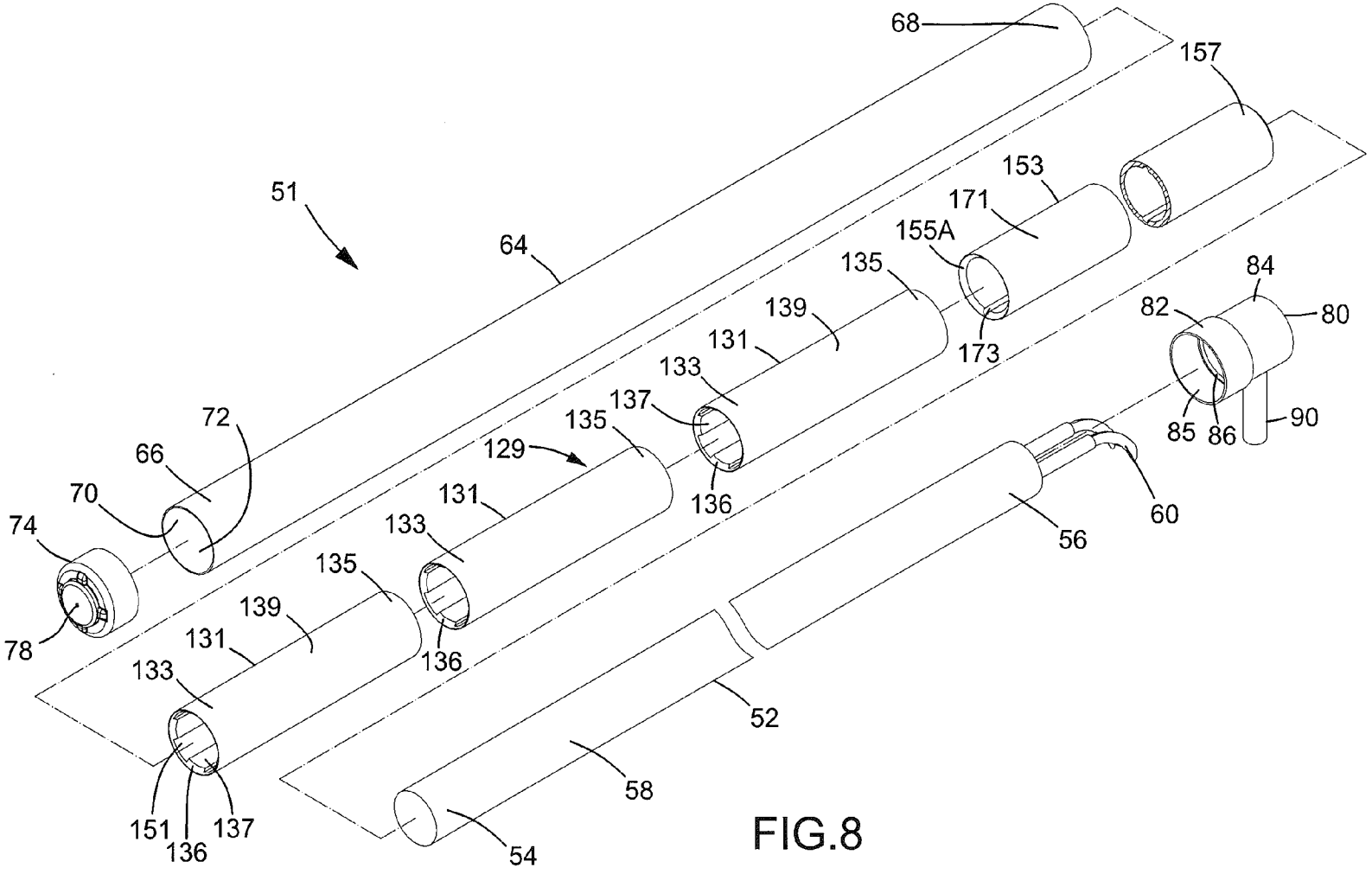
FIG. 8 is an exploded, perspective view of an instantaneous heater for a smoke generator of a second embodiment according to the present invention.
Figure 9:
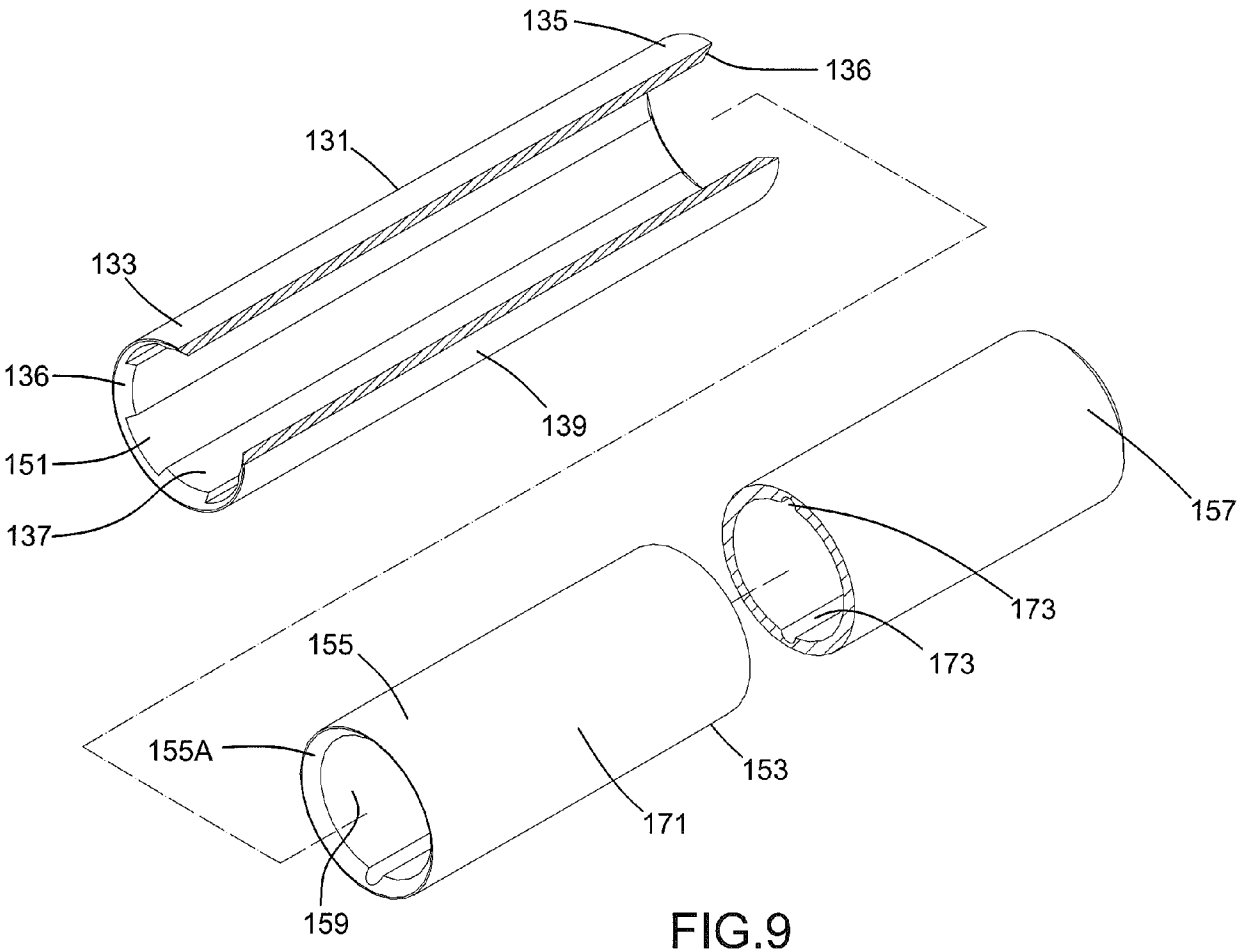
FIG. 9 is a partial, enlarged, perspective view of a first flow guiding member and a second flow guiding member of the instantaneous heater of FIG. 8.
Figure 10:
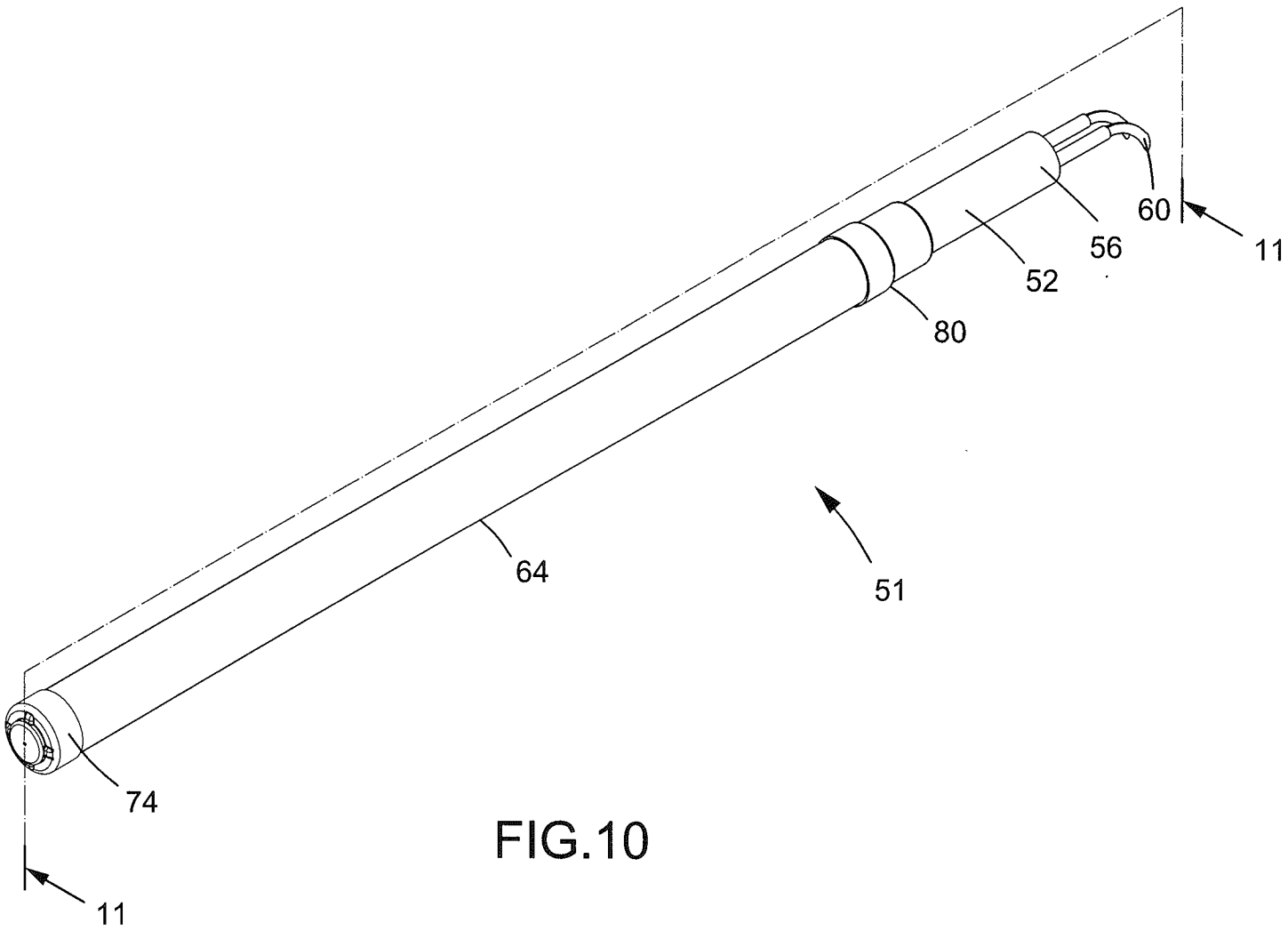
FIG. 10 is a perspective view of the instantaneous heater of FIG. 8 after assembly.
Figure 11:
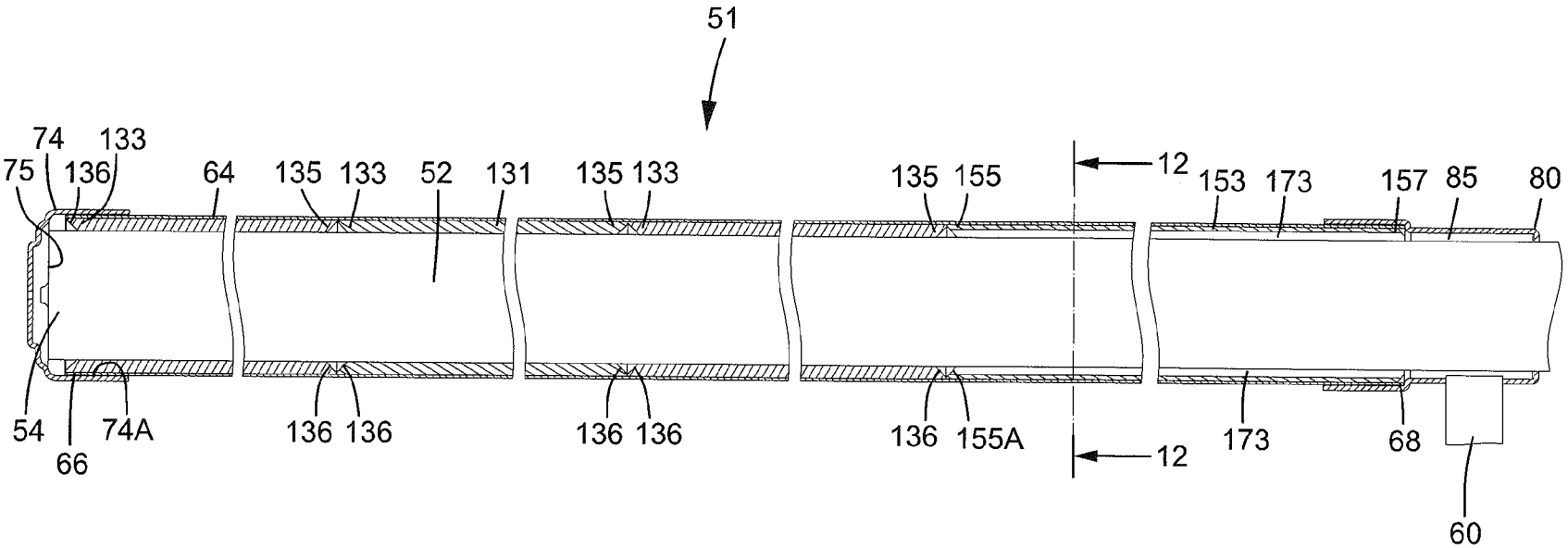
FIG. 11 is a cross sectional view taken along section line 11-11 of FIG. 10.
Figure 12:
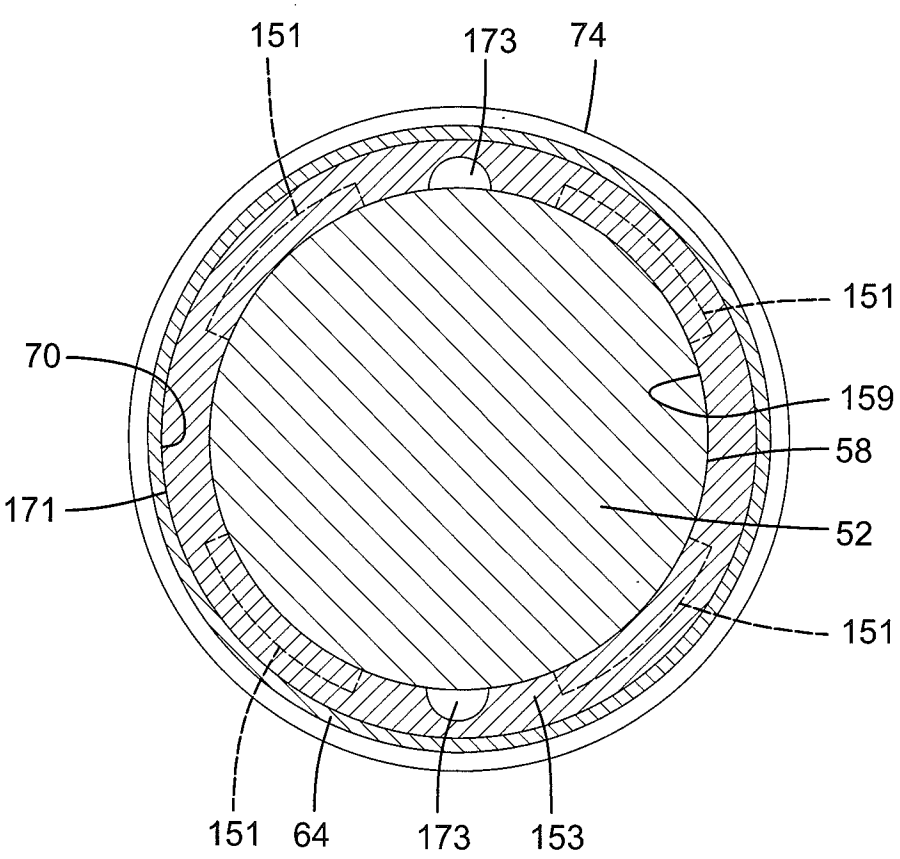
FIG. 12 is a cross sectional view taken along section line 12-12 of FIG. 11.

FIGS. 8-12 show an instantaneous heater 51 of a second embodiment. In the second embodiment, the instantaneous heater 51 includes three (front, middle, and rear) hollow first flow guiding members 131 and a second flow guiding member 153 that is also hollow. Each first flow guiding member 131 includes two first recessed portions 136 respectively defined in the end faces of the first and second ends 133 and 135 thereof (see FIG. 9).

The three first guiding members 131 are disposed around the heating rod 52 in sequence (starting from the second end 54 of the heating rod 52). The middle first flow guiding member 131 is located between the front and rear two first flow guiding members 131. The first end 133 of the middle first flow guiding member 131 abuts the second end 135 of the front first flow guiding member 131. The second end 135 of the middle first flow guiding member 131 abuts the first end 133 of the rear first flow guiding member 131 (see FIG. 11). Thus, the first recessed portions 136 of two adjacent first flow guiding members 131 together define an annular groove which is substantially V-shaped in a diametric cross section (see FIG. 11). Namely the three first flow guiding members 131 define two V-shaped annular grooves.

The second flow guiding member 153 includes a head end 155 and a tail end 157 spaced from the head end 155 along the longitudinal axis. The second flow guiding member 153 further includes an inner periphery 159 extending from the head end 155 through the tail end 157. The second flow guiding member 153 further includes two second heating passages 173 defined in the inner periphery 159 and extending from the head end 155 through the tail end 157. The two second heating passages 173 are diametrically disposed and uniformly distributed in the inner periphery 159 (see FIGS. 9 and 12). Furthermore, the cross sectional shape of each second heating passage 173 is different from the cross sectional shape of each first flow heating passage 151. The end face of the head end 155 of the second flow guiding member 153 includes a second recessed portion 155A.

The second flow guiding member 153 is mounted around the heating rod 52. The head end 155 of the second flow guiding member 153 abuts the second end 135 of the rear first flow guiding member 151. The second recessed portion 155A of the second flow guiding member 153 and the first recessed portion 136 of the second end 135 of the rear first flow guiding member 151 together define an annular groove which is substantially V-shaped in a diametric cross section (see FIG. 11). Furthermore, the tail end 157 of the second flow guiding member 153 is substantially aligned with the second end 68 of the outer tube 64. The tail end 157 of the second flow guiding member 153 is located in the space 85 of the connection cap 80. The outer periphery 171 of the second flow guiding member 153 abuts the inner periphery 70 of the outer tube 64. The two second heating passages 173 of the second flow guiding member 153 are spaced from the four first heating guiding members 151 of the first flow guiding member 131 in the circumferential direction about the longitudinal axis (see FIG. 12).

In the instantaneous heater 51 of the second embodiment, the flow guiding device 129 is separated into a plurality of sections (the front, middle, and rear first flow guiding members 131). Since the two second heating passages 173 of the second flow guiding member 153 are spaced from the four first heating guiding members 151 of the front, middle, and rear first flow guiding members 131 in the circumferential direction, the oil cannot smoothly flow through the V-shaped annular grooves between the first and second flow guiding members 131 and 153, such that the particles of the oil become smaller due to the non-smooth passageways, which is advantageous to rapid vaporization of the oil into smoke by the heating rod 52.

Furthermore, when the oil flows from each first heating passage 151 to one of the second heating passages 151, the particles of the oil become smaller due to the non-smooth passageways, which is advantageous to rapid vaporization of the oil into smoke by the heating rod 52.

The instantaneous heater 51 directly uses the heating rod 52 to heat and vaporize the oil into smoke, and each shallow, rectilinear first heating passage 151 only permits a small amount of oil to pass therethrough, such that no heat accumulators and/or heat conducting devices are required to rapidly vaporize the oil for achieving the smoke effect. Thus, the heating rate can be increased, because the time for accumulating heat for preheating purposes in the conventional device is not required. Furthermore, heat accumulation for maintaining the temperature is not required during standby, such that undesired heat loss and undesired waste in electricity are avoided, saving electricity.

Furthermore, the time for preheating of the smoke generator 10 is greatly reduced, because the heating rod 52 directly heats the oil. Since the time of preheating is relatively short, when the smoke generator 10 is in the standby state, temperature maintaining and the material therefor are not required. Thus, the standby temperature of the smoke generator 10 can be greatly reduced while greatly reducing the interior space of the smoke generator 10. Thus, the overall volume of the smoke generator 10 can be greatly reduced to permit more flexibility in appearance design while reducing the material costs. Furthermore, the damage possibility of the electronic components of the smoke generator 10 can be reduced. The material costs can be further cut, because the material for maintaining temperature is not required.

In view of the foregoing, the smoke generator 10 continuously outputs the smoke, greatly reduces the manufacturing costs, reduces the volume of the smoke generator 10, permits more flexibility appearance deign, reduces the temperature during standby, and reduces the electricity consumption to provide an electricity saving effect.

Now that the basic teachings of the present invention have been explained, many extensions and variations will be obvious to one having ordinary skill in the art. For example, the first flow guiding member 131 can include only one shallow, rectilinear heating passage 151. Furthermore, the flow guiding device 129 can include only one flow heating member 131 and a second flow guiding member 153. In this case, the first flow guiding member 131 only includes a first recessed portion 136 in the end face of the second end 135 thereof. The first recessed portion 136 of the first flow guiding member 131 and the second recessed portion 155A of the second flow guiding member 153 together form a V-shaped annular groove that assists in vaporization of the oil passing therethrough.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An instantaneous heater for a smoke generator comprising:

a heating rod including a first section, a second section spaced from the first section along a longitudinal axis, and an outer periphery extending between the first section and the second section, with the second section adapted to be electrically connected to a power supply system;

a first flow guiding member mounted around the heating rod, with the first flow guiding member including a first end, a second end spaced from the first end along the longitudinal axis, and an inner periphery extending from the first end through the second end, with the first flow guiding member further including a first heating passage defined in the inner periphery of the first flow guiding member and extending from the first end through the second end of the first flow guiding member, with the first heating passage being shallow and rectilinear, with the first end of the first flow guiding member aligned with the second section of the heating rod, and with the inner periphery of the first flow guiding member abutting the outer periphery of the heating rod;

an outer tube mounted around the first flow guiding member, with the outer tube including a first end facing the first section of the heating rod and a second end facing the second section of the heating rod, with the outer tube further including an inner periphery extending from the first end through the second end of the outer tube, with the inner periphery of the outer tube defining a chamber, and with the first flow guiding member received in the chamber;

an end cap sealingly mounted to the first end of the outer tube, with the end cap including an outlet intercommunicated with the first heating passage, and with the end cap covering the first section of the heating rod;

a connection cap sealingly mounted to the second end of the outer tube, with the connection cap including a space intercommunicated with the first heating passage; and a guiding tube including a first end coupled to the connection cap and intercommunicated with the space, with the guiding tube further including a second end adapted to be intercommunicated with an oil tank of the smoke generator, with the end cap including a compartment defined in an end face thereof, with the compartment including a bottom wall having an abutment face, with the first section of the heating rod having an end face abutting the abutment face of the end cap, with the end cap further including a guiding groove defined in the abutment face, and with the first heating passage aligned with the guiding groove in a circumferential direction about the longitudinal axis.

2. The instantaneous heater for the smoke generator as claimed in claim 1, with the first end of the first flow guiding member located in the compartment of the end cap, and with the second end of the first flow guiding member located in the space of the connection cap.

3. The instantaneous heater for the smoke generator as claimed in claim 1, wherein the first heating passage of the first flow guiding member is spaced from the second heating passage of the second flow guiding member in the circumferential direction.

4. The instantaneous heater for the smoke generator as claimed in claim 1, with the second end of the first flow guiding member including an end face having a first recessed portion, with the head end of the second flow guiding member including an end face having a second recessed portion, and with the first recessed portion and the second recessed portion together defining an annular groove.

5. The instantaneous heater for the smoke generator as claimed in claim 4, wherein the annular groove formed by the first and second recessed portions is substantially V-shaped in a diametric cross section.

6. An instantaneous heater for a smoke generator comprising:

a heating rod including a first section, a second section spaced from the first section along a longitudinal axis, and an outer periphery extending between the first section and the second section, with the second section adapted to be electrically connected to a power supply system;

a first flow guiding member mounted around the heating rod, with the first flow guiding member including a first end, a second end spaced from the first end along the longitudinal axis, and an inner periphery extending from the first end through the second end, with the first flow guiding member further including a first heating passage defined in the inner periphery of the first flow guiding member and extending from the first end through the second end of the first flow guiding member, with the first heating passage being shallow and rectilinear, with the first end of the first flow guiding member aligned with the second section of the heating rod, and with the inner periphery of the first flow guiding member abutting the outer periphery of the heating rod;

an outer tube mounted around the first flow guiding member, with the outer tube including a first end facing the first section of the heating rod and a second end facing the second section of the heating rod, with the outer tube further including an inner periphery extending from the first end through the second end of the outer tube, with the inner periphery of the outer tube defining a chamber, and with the first flow guiding member received in the chamber;

an end cap sealingly mounted to the first end of the outer tube, with the end cap including an outlet intercommunicated with the first heating passage, and with the end cap covering the first section of the heating rod;

a connection cap sealingly mounted to the second end of the outer tube, with the connection cap including a space intercommunicated with the first heating passage; and a guiding tube including a first end coupled to the connection cap and intercommunicated with the space, with the guiding tube further including a second end adapted to be intercommunicated with an oil tank of the smoke generator, with the end cap further including a compartment, with the first end of the outer tube coupled in the compartment of the end cap, with the first end of the first flow guiding member located in the compartment of the end cap, with the instantaneous heater further comprising a second flow guiding member having a head end and a tail end spaced from the head end along the longitudinal axis, with the second flow guiding member further including an inner periphery and a second heating passage defined in the inner periphery of the second flow guiding member and extending from the head end through the tail end of the second flow guiding member, with the second flow guiding member mounted around the heating rod, with the head end of the second flow guiding member abutting the second end of the first flow guiding member, and with the tail end of the second flow guiding member located in the space of the connection cap.

7. The instantaneous heater for the smoke generator as claimed in claim 6, wherein the first heating passage of the first flow guiding member is spaced from the second heating passage of the second flow guiding member in the circumferential direction.

8. The instantaneous heater for the smoke generator as claimed in claim 6, with the second end of the first flow guiding member including an end face having a first recessed portion, with the head end of the second flow guiding member including an end face having a second recessed portion, and with the first recessed portion and the second recessed portion together defining an annular groove.

9. The instantaneous heater for the smoke generator as claimed in claim 8, wherein the annular groove formed by the first and second recessed portions is substantially V-shaped in a diametric cross section.

10. An instantaneous heater for a smoke generator comprising:

a heating rod including a first section, a second section spaced from the first section along a longitudinal axis, and an outer periphery extending between the first section and the second section, with the second section adapted to be electrically connected to a power supply system;

three first flow guiding members mounted around the heating rod in sequence, with each of the three first flow guiding members including a first end, a second end spaced from the first end along the longitudinal axis, and an inner periphery extending from the first end through the second end, with each of the three first flow guiding members further including a first heating passage defined in the inner periphery thereof and extending from the first end through the second end thereof, with the first heating passages being shallow and rectilinear, with the three first flow guiding members including a front first flow guiding member, a rear first flow guiding member, and a middle first flow guiding member located between the front and rear first flowing guiding members, with the first end of the middle first flow guiding member abutting the second end of the front first flow guiding member, with the second end of the middle first flow guiding member abutting the first end of the rear first flow guiding member, and with the inner periphery of each of the three first flow guiding members abutting the outer periphery of the heating rod;

a second flow guiding member having a head end and a tail end spaced from the head end along the longitudinal axis, with the second flow guiding member further including an inner periphery and a second heating passage defined in the inner periphery of the second flow guiding member and extending from the head end through the tail end of the second flow guiding member, with the second flow guiding member mounted around the heating rod, and with the head end of the second flow guiding member abutting the second end of the rear first flow guiding member;

an outer tube mounted around the three first flow guiding members, with the outer tube including a first end facing the first section of the heating rod and a second end facing the second section of the heating rod, with the outer tube further including an inner periphery extending from the first end through the second end of the outer tube, with the inner periphery of the outer tube defining a chamber, and with the three first flow guiding members received in the chamber;

an end cap sealingly mounted to the first end of the outer tube, with the end cap including an outlet intercommunicated with the first heating passage, with the end cap covering the first section of the heating rod;

a connection cap sealingly mounted to the second end of the outer tube, with the connection cap including a space intercommunicated with the first heating passage, and with the tail end of the second flow guiding member located in the space of the connection cap; and a guiding tube including a first end coupled to the connection cap and intercommunicated with the space, with the guiding tube further including a second end adapted to be intercommunicated with an oil tank of the smoke generator.

11. The instantaneous heater for the smoke generator as claimed in claim 10, with each of the three first flow guiding members further including a first recessed portion defined in an end face of each of the first and second ends thereof, with the second flow guiding member including a second recessed portion defined in an end face of the head end, with the first recessed portions of the front and middle first flow guiding members together defining a first annular groove, with the first recessed portions of the middle and rear first flow guiding members together defining a second annular groove, and with the first recessed portion of the rear first flow guiding member and the second recessed portion of the second flow guiding member together defining a third annular groove.

12. The instantaneous heater for the smoke generator as claimed in claim 11, wherein each of the first, second, and third annular grooves is substantially V-shaped in a diametric cross section.

13. The instantaneous heater for the smoke generator as claimed in claim 10, wherein a ratio of a thickness between the inner periphery and the outer periphery of the first flow guiding member in a radial direction perpendicular to the longitudinal axis to a radial thickness of the heating rod in the radial direction is between 1:6 and 1:8, and wherein a ratio of a depth of each first heating passage in the radial direction to the thickness between the inner periphery to the outer periphery of the first flow guiding member is between 1:1.5 and 1:2.5.

14. An instantaneous heater for a smoke generator comprising:

a heating rod including a first section, a second section spaced from the first section along a longitudinal axis, and an outer periphery extending between the first section and the second section, with the second section adapted to be electrically connected to a power supply system;

a first flow guiding member mounted around the heating rod, with the first flow guiding member including a first end, a second end spaced from the first end along the longitudinal axis, and an inner periphery extending from the first end through the second end, with the first flow guiding member further including a first heating passage defined in the inner periphery of the first flow guiding member and extending from the first end through the second end of the first flow guiding member, with the first heating passage being shallow and rectilinear, with the first end of the first flow guiding member aligned with the second section of the heating rod, and with the inner periphery of the first flow guiding member abutting the outer periphery of the heating rod;

an outer tube mounted around the first flow guiding member, with the outer tube including a first end facing the first section of the heating rod and a second end facing the second section of the heating rod, with the outer tube further including an inner periphery extending from the first end through the second end of the outer tube, with the inner periphery of the outer tube defining a chamber, and with the first flow guiding member received in the chamber;

an end cap sealingly mounted to the first end of the outer tube, with the end cap including an outlet intercommunicated with the first heating passage, and with the end cap covering the first section of the heating rod;

a connection cap sealingly mounted to the second end of the outer tube, with the connection cap including a space intercommunicated with the first heating passage; and a guiding tube including a first end coupled to the connection cap and intercommunicated with the space, with the guiding tube further including a second end adapted to be intercommunicated with an oil tank of the smoke generator, wherein a ratio of a thickness between the inner periphery and the outer periphery of the first flow guiding member in a radial direction perpendicular to the longitudinal axis to a radial thickness of the heating rod in the radial direction is between 1:6 and 1:8, and wherein a ratio of a depth of each first heating passage in the radial direction to the thickness between the inner periphery to the outer periphery of the first flow guiding member is between 1:1.5 and 1:2.5.

15. The instantaneous heater for the smoke generator as claimed in claim 14, wherein the first heating passage of the first flow guiding member is spaced from the second heating passage of the second flow guiding member in the circumferential direction.

16. The instantaneous heater for the smoke generator as claimed in claim 14, with the second end of the first flow guiding member including an end face having a first recessed portion, with the head end of the second flow guiding member including an end face having a second recessed portion, and with the first recessed portion and the second recessed portion together defining an annular groove.

17. The instantaneous heater for the smoke generator as claimed in claim 16, wherein the annular groove formed by the first and second recessed portions is substantially V-shaped in a diametric cross section.

* * * * *